United States Patent [19]

Elsner et al.

[11] 4,243,748

[45] Jan. 6, 1981

[54] LIGHT-SENSITIVE SILVER HALIDE REPRODUCTION MATERIAL

[75] Inventors: Götz Elsner, Schwalbach; Rudolf F. Legler, Rödermark; Margarete Popovici, Langen, all of Fed. Rep. of Germany

[73] Assignee: E. I. Du Pont de Nemours and Company, Wilmington, Del.

[21] Appl. No.: 42,938

[22] Filed: May 29, 1979

[51] Int. Cl.[3] ..... G03C 1/06; G03C 1/28; G03C 1/34

[52] U.S. Cl. ..... 430/600; 430/603; 430/611; 430/613; 430/614; 430/621; 430/955; 430/966

[58] Field of Search ..... 430/600, 603, 611, 613, 430/614, 966, 963, 955, 960, 949, 355, 621

[56] References Cited

U.S. PATENT DOCUMENTS

| | | | |
|---|---|---|---|
| 2,385,762 | 9/1945 | Mueller | 430/611 |
| 2,440,110 | 4/1948 | Mueller | 430/611 |
| 2,449,153 | 9/1948 | Urbach | 430/611 |
| 2,465,149 | 3/1949 | Dersch et al. | 430/611 |
| 2,860,985 | 11/1958 | Dann et al. | 430/611 |
| 2,955,036 | 10/1960 | Dersch et al. | 96/66 |
| 3,068,100 | 12/1962 | Dersch | 96/66 |
| 3,565,625 | 2/1971 | Scavron | 430/600 |
| 3,708,302 | 1/1973 | Plakunov | 430/600 |
| 3,753,719 | 8/1973 | Sakamoto | 430/611 |
| 3,843,372 | 10/1974 | Jefferson | 430/611 |
| 3,869,289 | 3/1975 | Amering | 96/66 |

*Primary Examiner*—Mary F. Downey

[57] ABSTRACT

A light-sensitive silver halide reproduction material of high gradation stability which contains a disulfide compound substituted by two heterocyclic radicals, and a thiazolidine compound.

5 Claims, No Drawings

LIGHT-SENSITIVE SILVER HALIDE REPRODUCTION MATERIAL

The invention relates to a light-sensitive silver halide reproduction material of high gradation stability and more particularly, one which contains a disulfide compound substituted by two heterocyclic radicals and a thiazolidine compound.

BACKGROUND OF THE INVENTION

Silver halide reproduction materials which contain disulfide compounds substituted by two heterocyclic radicals are known and are described, e.g., in U.S. Pat. Nos. 2,440,110 and 2,465,149. These serve to prevent fogging of silver halide emulsions and/or to improve the fog-lowering effect of sulfinic or seleninic acids.

Silver halide materials which contain thiazolidine carboxylic acids are likewise known and described, e.g., in U.S. Pat. No. 3,565,625. They are used here to improve the sensitivity-fogging ratio. Moreover, it is stated in P. Glafkides, Chimie et Physique Photographiques, 3d edition, Paris, 1967, p. 313, that thiazolidine carboxylic acids act as contrast-modifying desensitizers whereby negative emulsions are desensitized, while with positive emulsions gradation is elevated at the cost of sensitivity.

It is, moreover, known that in the development of a light-sensitive silver halide reproduction material the silver formed, and thus also gradation, which largely determines the image character, depends to a great extent on development conditions, especially on time and temperature of development. Therefore, it is endeavored to keep the time and temperature of development as constant as possible. In actual practice, however, this has not been possible to a satisfactory degree.

Gradation stability is of special significance in the development of x-ray films where for diagnostic reasons a high constancy of gradation is required. Today, as a result of the short development times used, these are very susceptible to deviations of development conditions, especially against overdevelopment. Thus, the task of the present invention is to provide a light-sensitive silver halide reproduction material which excels in high gradation stability during development under various conditions.

SUMMARY OF THE INVENTION

This task was solved by a light-sensitive silver halide reproduction material, which, if desired, is hardened and which consists of a support film, at least one light-sensitive silver halide emulsion layer, and, if desired, additional nonlight-sensitive auxiliary layers, characterized in that the reproduction material contains (a) a disulfide compound of the formula

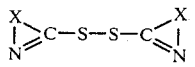

and (b) a thiazolidine compound of the formula

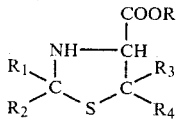

wherein X represents the atoms necessary to complete, if desired, a substituted heterocyclic ring, and R, $R_1$, $R_2$, $R_3$, and $R_4$ are the same or different and represent hydrogen, alkyl radicals with 1–4 carbon atoms, and aryl radicals.

DETAILED DESCRIPTION OF THE INVENTION

Suitable heterocyclic rings for the disulfide compound are oxazol, thiazol, imidazol, pyrimidine, oxadiazol, thiadizol, triazol, tetrazol, etc.

For additional examples of suitable heterocycles, see E. J. Birr, Stabilization of Photographic Silver Halide Emulsions, "The Focal Press", London and New York, 1974. The heterocyclic rings can also be substituted or can be parts of polynuclear ring systems. Examples of this, for example, are 2-aminothiadiazol, 1-phenyl-tetrazol, benzthiazol, etc. Disulfide compounds are added to the photographic silver halide emulsion in amounts of 10–30 mg/mole silver halide as ca. 0.5% solutions in aqueous or water-miscible organic solvents. Addition can be at any point in time, preferably after chemical ripening. It is also possible to add the disulfide compounds to a water-permeable auxiliary layer in direct contact with the photographic emulsion layer.

An especially suitable disulfide compound is bis-(5-mercapto-1,3,4-thiadiazol-2 yl-) disulfide, which, in addition to its good gradation stabilizing effect, further excels by providing especially good stability for the remaining sensitometric data. Anhydrous organic solvents have proven to be best as solvents for this disulfide, as for example, methanol, anhydrous ethanol, or dimethyl formamide.

The thiazolidine compounds, or, if desired, their salts, are added to the photographic silver halide emulsion in amounts of 5–20 mg/mole silver halide as ca. 0.5% aqueous solutions at a random point in time, preferably after chemical ripening. It is also possible to add the thiazolidine compounds to a water-permeable auxiliary layer in direct contact with the photographic emulsion.

In a special form of embodiment, suitable thiazolidine precursor compounds can also be added in place of the thiazolidine compounds. In this case, the photographic silver halide emulsion must be hardened by an aldehyde hardening agent, for example, by formaldehyde or glyoxal or glutardialdehyde, etc. which reacts with the precursor compound to form a thiazolidine compound. For example, cystein or penicillamine, etc. are suitable precursor compounds for this purpose. In addition to the disulfide compounds of the invention and the thiazolidine compounds, the photographic emulsions can contain conventional chemical and, if desired, optical sensitizers as well as conventional stabilizers and antifogging agents. Moreover, the emulsion may also contain additives elevating the covering power; also wetting agents, antistatic agents, hardeners, etc.

EXAMPLE 1

A highly sensitive silver bromoiodide emulsion with about 2 mole % AgI was prepared which contained 5 wt. % gelatin and 10 wt. % silver halide. This emulsion was divided into 4 parts. Part A contained no additives of the invention, while to Parts B, C and D were added the ingredients indicated in the table, shortly before coating.

| Sample | Disulfide Compound per mole silver halide | Thiazolidine Compound per mole silver halide |
|---|---|---|
| A | — | — |
| B | — | 17 mg thiazolidine-4-carboxylic acid |
| C | 17 mg Bis-(1-phenyl-tetrazolyl-5-disulfide | — |
| D | 17 mg Bis-(1-phenyl-tetrazolyl-5-disulfide | 17 mg thiazolidine-4-carboxylic acid |

The emulsions were coated according to known processes onto a polyethylene glycol terephthalate film support and were dried. These light-sensitive materials were exposed, developed, and subjected to a normal sensitometric evaluation, wherein a developer of the following composition was used:

| | | |
|---|---|---|
| Hydroquinone | | 30.00 g |
| 1-Phenyl-3-pyrazolidone | | 1.00 g |
| $Na_2SO_3$ (anhydrous) | | 60.00 g |
| KOH | | 23.00 g |
| $NaBO_2 . 4H_2O$ | | 20.00 g |
| Water | to | 1 liter |

15, 22 and 51 s were selected as times of development. The results are summarized in the following table.

| | UNDER-DEVELOPMENT 34° C./15 s | | | NORMAL DEVELOPMENT 34° C./22 s | | | OVER DEVELOPMENT 34° C./51 s | | |
|---|---|---|---|---|---|---|---|---|---|
| SAMPLE | % Sensitivity | Gradation | Fog | % Sensitivity | Gradation | Fog | Sensitivity | Gradation | Fog |
| A | 74 | 3.5 | 0.16 | 100 | 3.3 | 0.20 | 170 | 2.5 | 0.31 |
| B | 98 | 3.4 | 0.23 | 129 | 3.3 | 0.24 | 195 | 2.6 | 0.34 |
| C | 66 | 3.4 | 0.16 | 77 | 3.5 | 0.17 | 126 | 2.9 | 0.19 |
| D | 98 | 3.3 | 0.20 | 129 | 3.3 | 0.20 | 190 | 3.2 | 0.31 |

Evaluation points out the gradation-stabilizing effect of Sample D of the invention against comparative Sample A and Samples B and C containing the individual components.

EXAMPLE 2

The silver emulsion described in Example 1 was prepared and divided into 3 parts. To the individual parts, shortly before coating, were added the disulfide- and thiazolidine compounds indicated in the following table.

| Sample | Disulfide Compound per mole silver halide | Thiazolidine Compound per mole silver halide |
|---|---|---|
| A | — | — |
| B | 13 mg Bis-(5-acetyl-mercapto-1,3,4-thiadiazolyl-2-) disulfide | 11 mg 2-methyl-thiazolidine-4-carboxylic acid |

-continued

| Sample | Disulfide Compound per mole silver halide | Thiazolidine Compound per mole silver halide |
|---|---|---|
| C | 13 mg Bis-(5-mercapto-) thiadiazolyl-2-disulfide | 11 mg Thiazolidine-4-carboxylic acid |

The emulsions were coated, dried, exposed and developed as indicated. Evaluation indicated the following values:

| Sample | Gradation with under-development 34° C./15 s | Gradation with normal development 34° C./22 s | Gradation with over-development 34° C./51 s |
|---|---|---|---|
| A | 3.4 | 3.2 | 2.3 |
| B | 3.4 | 3.4 | 2.9 |
| C | 3.4 | 3.2 | 3.1 |

The gradation-stabilizing effect of the additives of the invention with longer development times is clearly illustrated.

EXAMPLE 3

A silver halide emulsion as described in Example 1 was prepared and divided into 4 parts. To the individual parts, shorting before casting, were added the disulfide- and thiazolidine compounds indicated in the following table.

| Sample | Disulfide Compound per mole silver halide | Thiazolidine Compound per mole silver halide |
|---|---|---|
| A | — | — |
| B | 27 mg Bis-(1-phenyl-tetrazolyl-5-) disulfide | 7 mg 2,2'-dimethyl-thiazolidine-4-carboxylic acid |
| C | 11 mg Bis-(benz-thiazolyl-2-) disulfide | 10 mg Thiazolidine-4-carboxylic acid ethyl ester |
| D | 11 mg Bis-(5-amino-thiadiazolyl-2-) disulfide | 10 mg Thiazolidine-4-carboxylic acid ethyl ester. |

The emulsions were coated and dried as indicated. After exposure, development took place at 30°, 34° and 38° C. Evaluation yielded the following values:

| Sample | Gradation with under-development 30° C./22 s | Gradation with normal development 34° C./22 s | Gradation with over-development 38° C./22 s |
|---|---|---|---|
| A | 3.2 | 3.2 | 2.1 |
| B | 3.3 | 3.3 | 2.8 |
| C | 3.2 | 3.1 | 2.7 |
| D | 3.4 | 3.3 | 2.9 |

As seen from the above table, the same gradation-stabilizing effect is also evident upon variation of the temperature of development.

EXAMPLE 4

The effect of the invention is also seen when using thiazolidine precursor compound in combination with a disulfide compound.

A silver halide emulsion as described in Example 1 was prepared and hardened using formaldehyde. The emulsion was divided into 3 parts to which were added a disulfide compound and, in place of the thiazolidine compound, a precursor compound from the following table:

| Sample | Disulfide Compound per mole silver halide | Thiazolidine Precursor Compound per mole silver halide |
|---|---|---|
| A | — | — |
| B | — | 7 mg Cystein |
| C | 13 mg Bis(-1-phenyl-tetrazolyl-5-) disulfide | 7 mg Cystein |

The emulsions were coated, dried, exposed and developed as indicated. Evaluation yielded the following values:

| Sample | Gradation with under-development 34° C./15 s | Gradation with normal development 34° C./22 s | Gradation with over-development 34° C./51 s |
|---|---|---|---|
| A | 3.3 | 3.2 | 2.6 |
| B | 3.2 | 2.9 | 2.4 |

-continued

| Sample | Gradation with under-development 34° C./15 s | Gradation with normal development 34° C./22 s | Gradation with over-development 34° C./51 s |
|---|---|---|---|
| C | 3.0 | 3.0 | 3.0 |

We claim:

1. A light-sensitive silver halide reproduction material which consists essentially of a support film, at least one light-sensitive silver halide emulsion layer, and (a) a disulfide compound of the formula

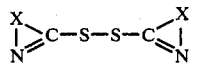

and (b) a thiazolidine compound of the formula

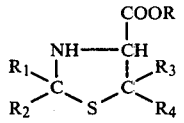

wherein X represents the atoms necessary to complete a substituted heterocyclic ring selected from the group consisting of oxazol, thiazol, imidazol, pyrimidine, oxadiazol, thiadizol, triazol, and tetrazol; and R, $R_1$, $R_2$, $R_3$, and $R_4$ are the same or different, and represent hydrogen, alkyl radicals of 1–4 carbon atoms, and aryl radicals.

2. The light-sensitive silver halide reproduction material of claim 1, wherein the disulfide compound is bis-(5-mercapto-1,3,4-thiadiazolyl-2-) disulfide, and the thiazolidine compound is thiazolidine-4-carboxylic acid.

3. The light-sensitive silver halide reproduction material of claim 1 or 2, which is hardened by an aldehyde hardener, wherein the material contains the thiazolidine compound in the form of a precursor compound.

4. The light-sensitive silver halide reproduction material of claim 3, containing cystein as the precursor compound.

5. The light-sensitive silver halide reproduction material of claim 1 which contains additional nonlight-sensitive auxiliary layers.

* * * * *